US007690647B2

(12) United States Patent
McNamara et al.

(10) Patent No.: US 7,690,647 B2
(45) Date of Patent: Apr. 6, 2010

(54) STACK HOLDING DEVICE TO PREVENT PUSH-OUT

(75) Inventors: Joseph M. McNamara, Orangeville (CA); Paul B. Crane, Bishops Stortford (GB)

(73) Assignee: Xerox Corporation, Norwalk, CT (US)

( * ) Notice: Subject to any disclaimer, the term of this patent is extended or adjusted under 35 U.S.C. 154(b) by 158 days.

(21) Appl. No.: 11/770,219

(22) Filed: Jun. 28, 2007

(65) Prior Publication Data

US 2009/0001659 A1 Jan. 1, 2009

(51) Int. Cl.
*B65H 31/00* (2006.01)

(52) U.S. Cl. ..... 271/207; 271/220

(58) Field of Classification Search ..... 271/220, 271/207; 414/789.9; 270/58.11, 58.13
See application file for complete search history.

(56) References Cited

U.S. PATENT DOCUMENTS 6,244,583 B1 * 6/2001 Ohmichi et al. ..... 270/58.09
6,722,646 B2 * 4/2004 Sekiyama et al. ..... 270/58.09

* cited by examiner

*Primary Examiner*—David H Bollinger
(74) *Attorney, Agent, or Firm*—Oliff & Berridge, PLC

(57) ABSTRACT

A mechanical device to stabilize the stack height position of a compiler output tray and compress the sets in the tray is provided. The small mechanical device may be mounted in the back wall of the stacker tray near the top limit. The mechanical device includes a gravity-activated arm that moves out of the way when a set is ejected and, then, when the stacker tray lowers, the arm returns to the extended position. The tray rises again to the compiling position for the next set, pushing the arm upwards and compressing the set against the rubber contact member. The compression reduces the stack height, increases tray capacity and prevents each new set from pushing out the top of the stack.

17 Claims, 8 Drawing Sheets

STACK HOLDING DEVICE TO PREVENT PUSH-OUT

BACKGROUND

This disclosure generally relates to xerographic machines (e.g., printers, copiers, scanner, production presses and the like) and specifically relates to the handling of media (e.g., pieces of plain paper), such as feeding, transporting and finishing.

Production presses are a kind of xerographic machine that are used to print direct mail marketing materials, brochures, books, flyers, postcards, newsletters catalogs, statements and financial reports, manuals, fulfillment of jobs submitted over the web, point of purchase materials, sell sheets and the like. Production presses are high volume machines, for example, printing over six thousand images per hour. Production presses may include up to six input feeder trays holding a wide array of stocks. Stocks are special types of media, for example, coated, uncoated, matte, dull, silk, textured, smooth, specialty, recycled, perforated, tabs and transparencies. The input feeder trays may hold tens of thousands of sheets of media. Production presses may include four output trays or stackers, each stacker having two carts. Each cart may hold three thousands sheets for a total of twenty-four thousand sheets of output. Production presses may include different kinds of finishing modules. Some examples of finishing include lamination, stitched sets, lay flat, tape bound, case bound, booklet making and stapling.

In a production press, a job may be processed (e.g., printed or copied), processed by a finisher and then transferred into an output tray. The sheets of media in the job, before they are processed by the finisher are called compiled sheets or a set of compiled sheets. For example, the finisher may staple each set of compiled sheets for a job of ten thousand copies of a two page stapled document, where each set of compiled sheets consists of two sheets to be stapled. When one or more set of compiled sheets are stacked in a tray waiting to be stapled, the compiling and ejecting of the next set may cause push-out, trail edge hang-ups or otherwise deteriorate the stack quality. Push-out may occur, for example, when the friction of the set of compiled sheets being moved, landing and coming to rest on the top of the stack moves (or pushes) the set of compiled sheets previously on the top of the stack (i.e., just under the set now on top). Trail edge hang-ups may occur, for example, when the trail edge of a sheet catches on something, such as a part of the machine or when the position of the sheet is not detected properly by a sensor as the sheet moves into the tray, resulting in the sheets in the stack not being stacked evenly or some other error. When the xerographic machine is a high volume machine, such as a production press, which may stack thousands of sheets in an output tray, any problems with trail edge hang-ups or push-out are exacerbated.

SUMMARY

Exemplary embodiments include a device for stabilizing a stack of media. The device includes an arm and a contact member. When the set in the stack of media is ejected, the arm moves to a first position in a direction away from the stack of media. When the stack of media lowers, the arm moves to a second position. The contact member is coupled to the arm for compressing the stack of media. The contact member compresses the stack by contacting the top of the stack as the stack rises to a compiling position for a next set. The arm may be gravity-activated. The contact member may compress the stack under a spring-load. The arm may be mounted to a spring-loaded frame to allow the arm to move up with the stack of media. The spring-loaded frame may include a pressing plate, a housing and a shaft. The pressing plate couples the arm to the contact member and has a pair of pivots. The housing has at least one bearing pivot coupled to a compression spring. The shaft passes through the pivots of the pressing plate and the bearing pivot of the housing. The bearing pivot may be shaped with a flat side to limit rotation of the pressing plate around the shaft. A pin may be disposed in the shaft to prevent over-rotation of the pressing plate around the shaft. A counterbalance to the arm with the contact member may be used for stabilizing the motion of the arm. The arm may be locked in a horizontal position as the contact member compresses the stack of media. Another embodiment is a finishing unit including one or more of these devices for stabilizing a stack of media.

Another exemplary embodiment is a method for stabilizing a stack of media. When a set in the stack of media is ejected, an arm is moved to a first position away from the stack of media. When the stack of media lowers, the arm is returned to a second position. As the stack of media rises to a compiling position for a next set, the top of the stack is compressed against a contact member coupled to the arm. The arm may be gravity-activated. The arm may also be locked in a horizontal position as the contact member compresses the stack of media. As the stack of media rises, the arm may be pushed upwards under a spring load. The arm may be moved to the first position in a direction away from the stack under the weight of the set being ejected. The arm may be returned to the second position due to an arm counterbalance.

EMBODIMENTS

Exemplary embodiments address the paper push-out problem experienced in some stacker trays by holding the paper firm as the next set is ejecting. One embodiment is a simple, cost-effective mechanical device, which when combined with a tray elevation system, provides a load to the sheets in the output tray. Some embodiments may be used with various media handling devices, such as finishers to prevent push-out (e.g., preventing a next set from pushing the top of the stack off the stack) and maintain stack quality.

Figure 1:
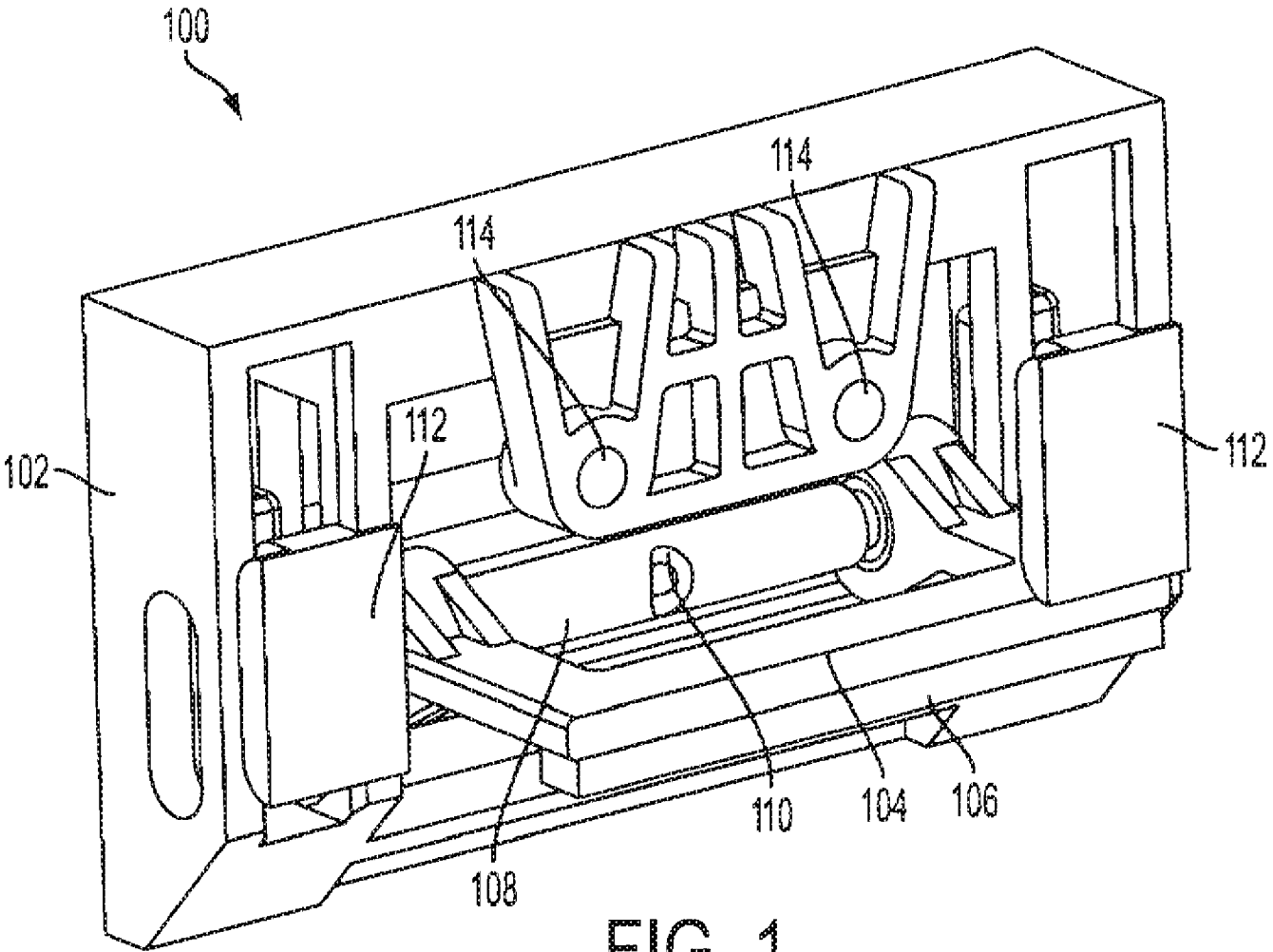
FIG. 1 illustrates a perspective view of an exemplary embodiment of a modular unit for stabilizing a stack of media.

FIG. 1 illustrates a perspective view of an exemplary embodiment of a modular unit 100 for stabilizing a stack of media. Other embodiments may have integrated components instead of a modular unit. In this exemplary embodiment, the modular unit includes a housing 102 providing a spring-loaded frame for a pressing plate 104 having a contact member 106 for contacting the top of a stack of media to compress the stack.

The pressing plate 104 may be a member having various structure. The pressing plate 104 rotates in a limited mailer around a shaft 108, which is fixed in position with a fastener 110, such as a pin. The pin may protrude slightly out of the shaft 108 and prevent the shaft 108 from over-rotating. In one embodiment, the pin is fastened substantially in the longitudinal center of the shaft 108. In one embodiment, the contact member 106 is a flexible material, such as rubber.

The housing 102 may have various structural features other than those shown in FIG. 1. The housing 102 may provide a spring-loaded frame for the arm of the pressing plate 104 in many ways, for example, by way of two bearing pivots 112. The modular unit 100 may be fastened in any manner to a surface (e.g., a wall of a stacking tray), such as through holes 114.

Figure 2:
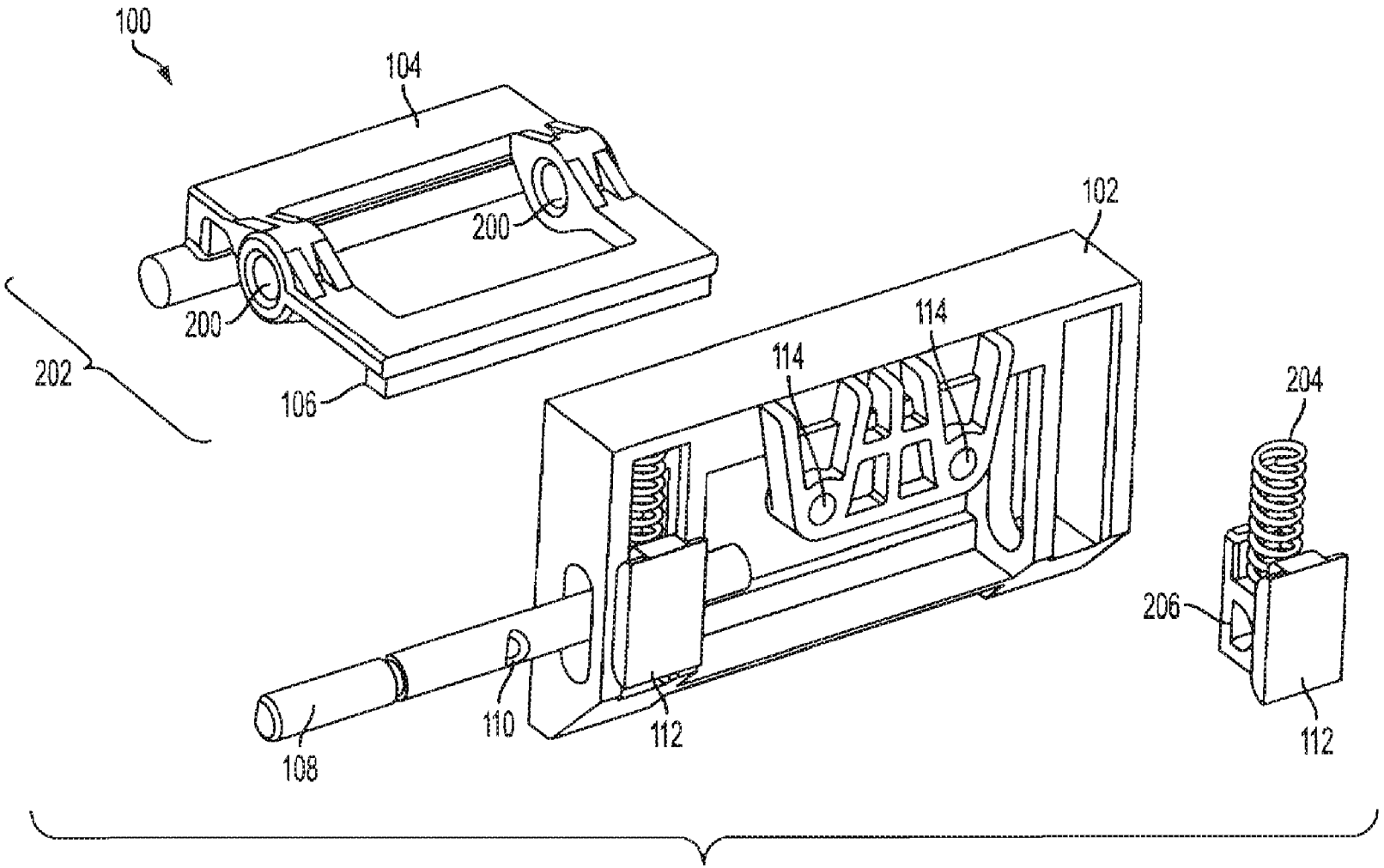
FIG. 2 illustrates an exploded view of the modular unit of FIG. 1.

FIG. 2 illustrates an exploded view of the modular unit 100 of FIG. 1. In FIG. 2, the pressing plate 104 and one of the bearing pivots 112 are removed from the housing 102 in the assembled modular unit of FIG. 1. In this exemplary embodiment, the pressing plate 104 has a pair of openings 200 having a size, shape, and alignment for receiving the shaft 108 when the pressing plate 104 and for fitting into the housing 102. The shaft 108 may be any cylindrical member with various structural features for engaging with the various structural features of the pressing plate 104 and the housing 102.

Once the shaft 108 is assembled to pass through the openings 200 in the pressing plate 104 in the housing 102, the arm 202 of the pressing plate 104 is able to rotate or pivot around the shaft 108; however the free rotation of the arm 202 is limited in some ways by the housing 102, shaft 108 and bearing pivots 112. The housing 102 acts as a spring-loaded frame to enable upward rotation (i.e., counterclockwise) and downward rotation (i.e., clockwise) of the arm 202 around the shaft 108, as will be described in more detail below. In other embodiments, the arm 202 may be positioned differently so that upward rotation is clockwise and downward rotation is counterclockwise.

The bearing pivots 112 each include a spring 204, which may be any kind of spring, such as compression spring, torsion spring or flat spring, and an opening 206 permitting the shaft 108 to pass through. The opening 206 of the bearing pivot 112 may enable locking the arm 202 of the pressing plate 104 in particular positions as the arm 202 rotates around the shaft 108 by, for example, being shaped with one flat side 206 (i.e., a D-shaped opening) or by applying D rings. Other embodiments prevent the shaft 108 from over-rotating by other means, such as machining a shape on the end of the shaft 108. The locking of the arm 202 will be described in more detail below. In one embodiment, the bearing pivots 112 allow for variation or tolerance in the height of the stacking tray to avoid breaking the shaft 108. In one embodiment, one end of the spring 204 goes around the shaft 108 and the other end of the spring 204 goes around the housing 102.

Figure 3:
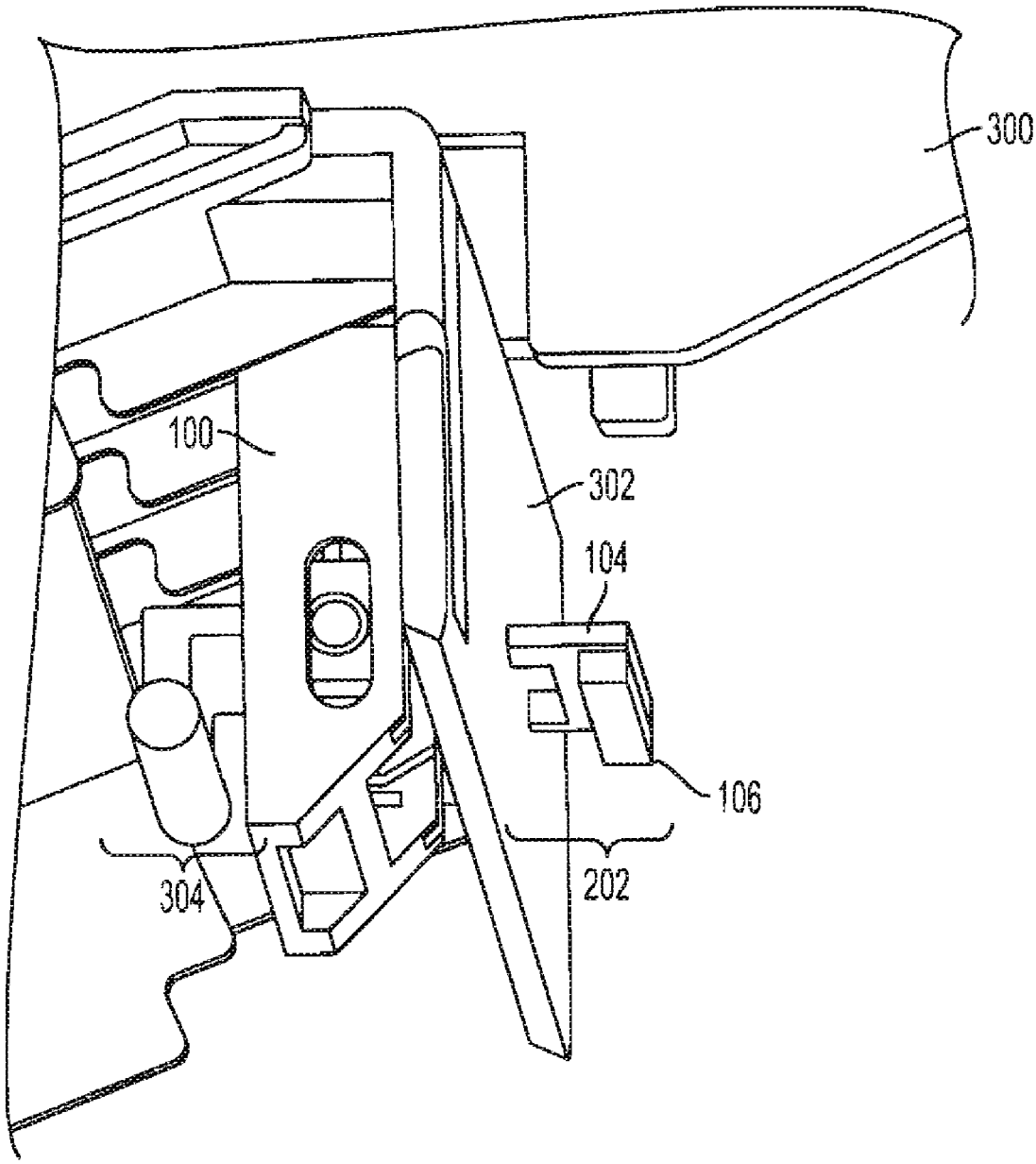
FIG. 3 illustrates a cut away view of the modular unit of FIG. 1 installed in a finisher with a horizontal orientation of an arm of the installed modular unit.

FIG. 3 illustrates a cut away view of the modular unit 100 of FIG. 1 installed in a finisher 300 of a xerographic machine (not shown). The rest of the compiling tray and portions of the finisher 300 are cut away to more clearly show the installation configuration of the modular unit 100. The modular unit 100 may be installed in many configurations, of which FIG. 1 is merely one configuration. FIG. 3 shows the arm 202 of the modular unit 100 passing through a vertical section 302 of a compiling tray (see FIG. 6). The vertical section 302 may have any kind of aperture permitting some rotational movement of the arm 202 about the shaft 108.

Figure 4:
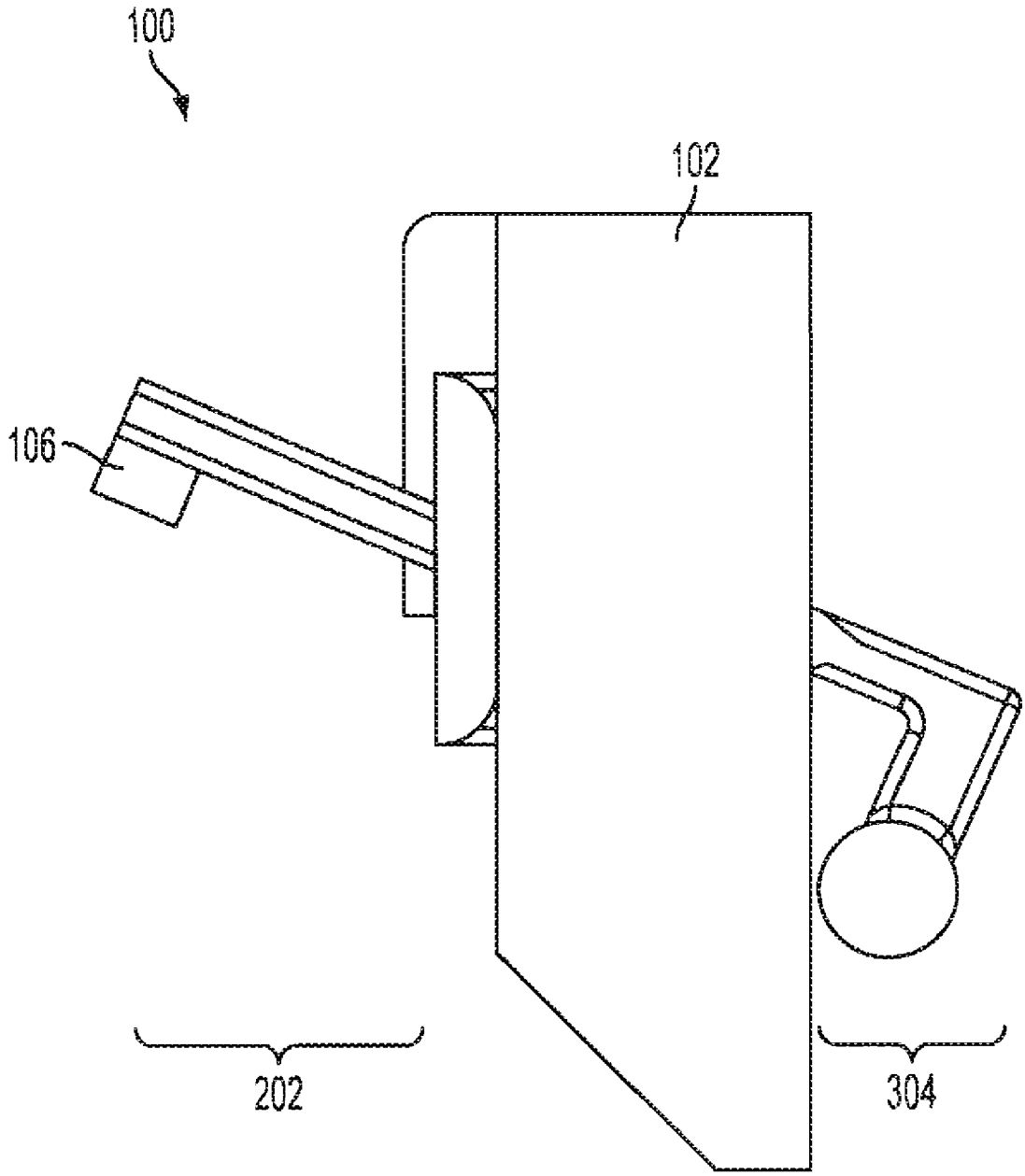
FIGS. 4 and 5 illustrate two different orientations of an arm of the installed modular unit of FIG. 3.
Figure 5:
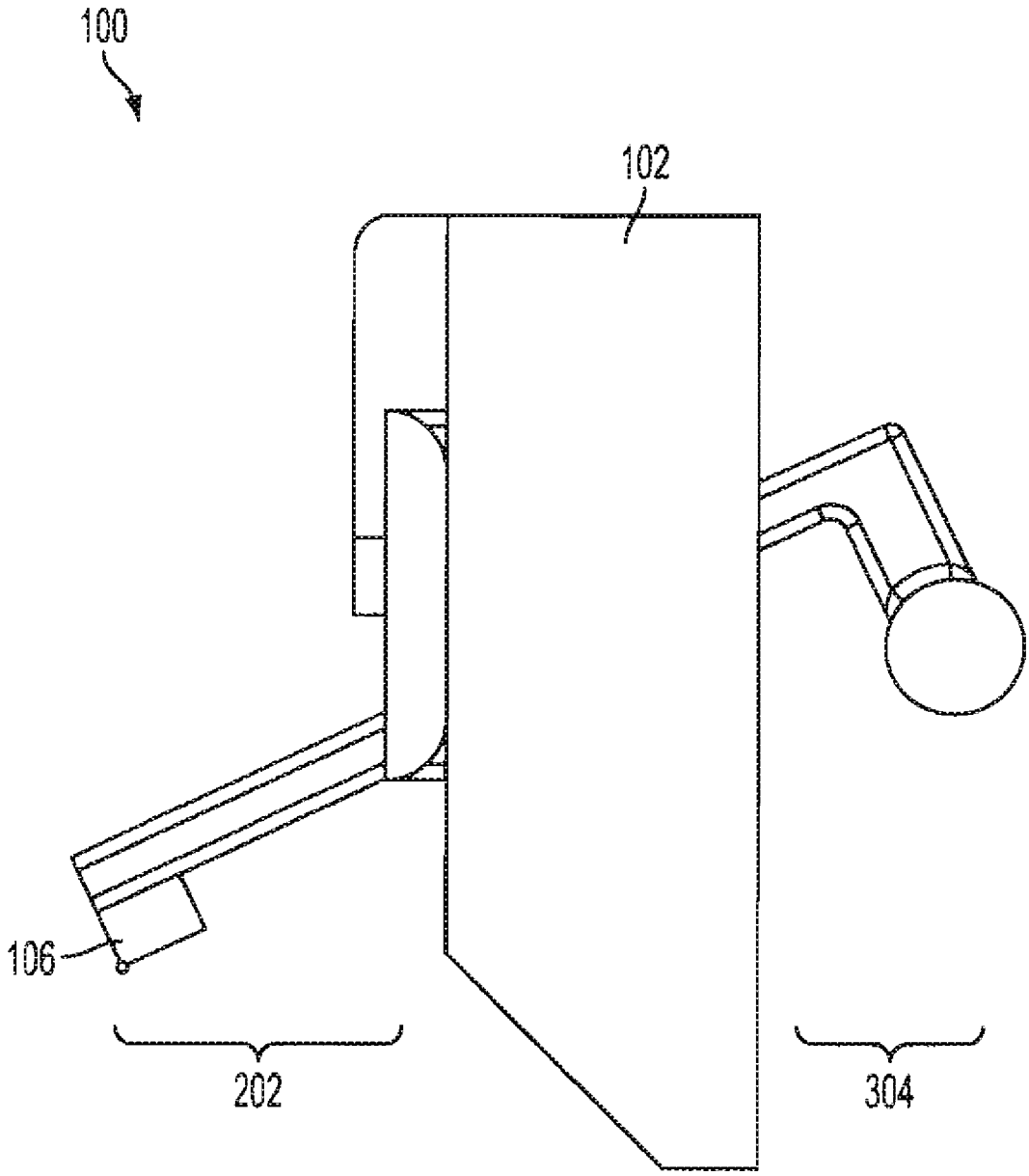

FIG. 3 shows the arm 202 and an arm counterbalance 304 of the modular unit 100 in a balanced, horizontal position, while FIGS. 4 and 5 show the arm in two additional orientations. The arm 202 may be locked in a horizontal position as the arm 202 moves up in parallel with the upward movement of a stacking tray (see FIGS. 6-8). The load applied by the arm 202 and the arm counterbalance 304 via the spring-loaded frame in the housing 102 compresses the stack in the stacking tray and prevents the top sheets in the stacking tray from being pushed out when the next set is ejected.

FIGS. 4 and 5 illustrate two different orientations of the arm 202 and the arm counterbalance 304 of the modular unit 100 of FIG. 3. One exemplary embodiment is a method for stabilizing a stack of media (not shown) located under the arm 202 (i.e., in the lower left corner of FIGS. 4 and 5). The stack of media is typically in a stacking tray (see FIGS. 6-8) that has an elevation mechanism for raising and lowering the stack. The stacking tray may operate in connection with one or more sensors for detecting the position of the stack in the tray, e.g., lowering the tray as the stack height increases.

When a set in the stack is ejected, the arm 202 is moved to a first position away from the stack, such as that shown in FIG. 4. The particular orientation or angle of rotation about the shaft 108 of the first position may vary in other embodiments.

When the stack lowers, the arm is returned to a second position, such as that shown in FIG. 5. Again, the particular orientation or angle of rotation for the second position may vary in other embodiments. As the stack of media rises to a compiling position for a next set, the top of the stack is compressed against the contact member 106 coupled to the arm 202. Sheets may be compiled or collected in sets in order to perform some finishing operation to the entire set of sheets. In this exemplary embodiment, some movement of the arm 202 and arm counterbalance 304 is under the force of gravity.

In this exemplary embodiment, the stack is stabilized and compressed by the arm 202 in patterns of rotational movement, locked positions, and stable positions, such as those shown in FIGS. 3-5. The arm 202 may be locked in a horizontal position as the contact member 106 compresses the stack, as shown in FIG. 3. The arm 202 may be pushed upwards under a spring load, as the stack rises, as shown in FIG. 4. The arm 202 may move to the first position away from the stack under the weight of the set being ejected, as shown in FIG. 4. The arm 202 may then return to the second position due to the arm counterbalance 304, as shown in FIG. 5.

Figure 6:
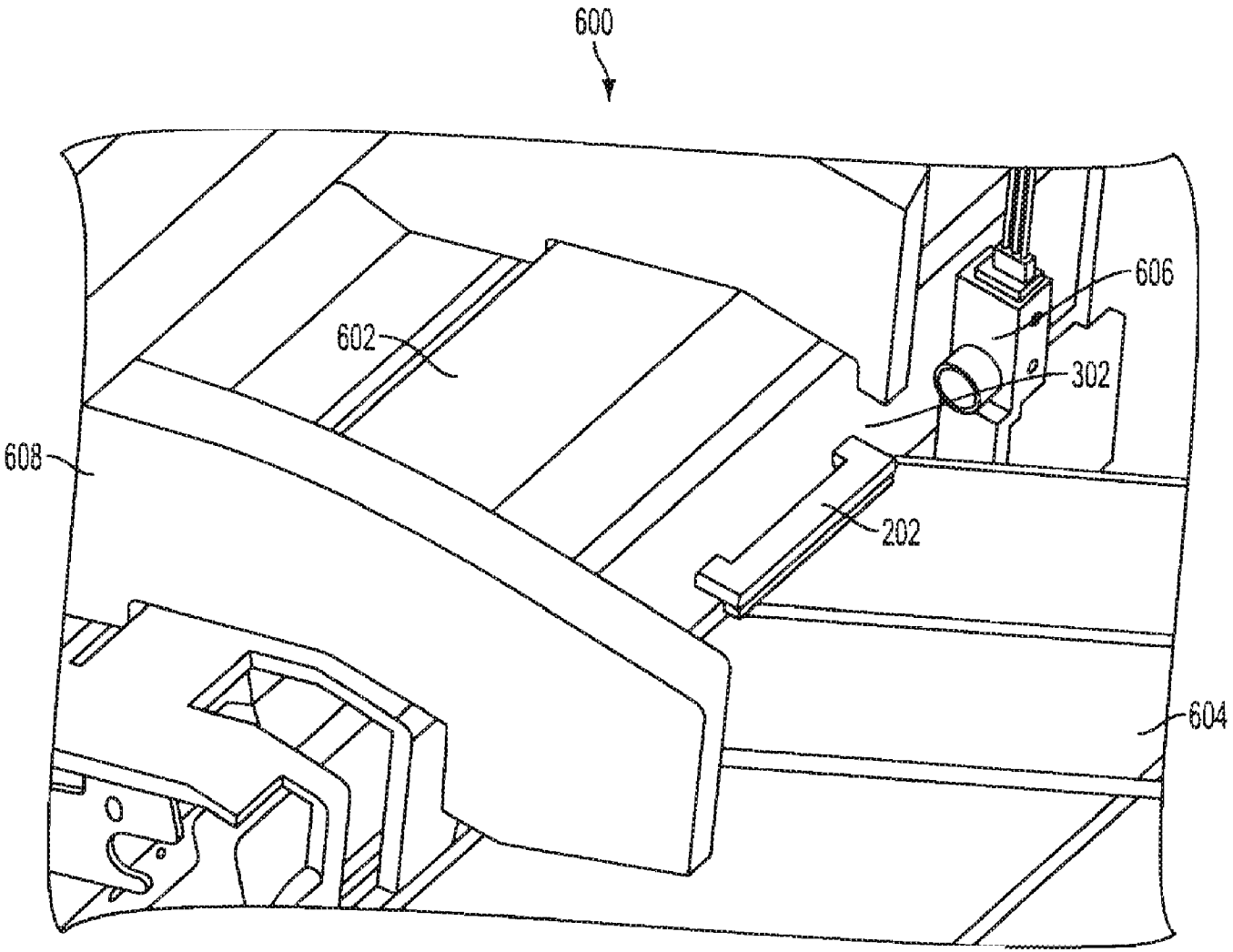
FIG. 6 illustrates a perspective view of the installed modular unit of FIG. 3.

FIG. 6 illustrates a perspective view of the installed modular unit 100 of FIG. 3, showing the modular unit 100 in relation to part of a finisher 600 in a xerographic machine. Only the arm 202 of the modular unit 100 is visible in FIG. 6 and the rest of the modular unit 100 is behind the vertical section 302 of the compiling tray 602. The finisher 600 includes a compiling tray 602, a stacking tray 604, and a sensor 606. Sheets processed by the finisher 600 travel down the compiling tray 602 over the vertical section 302 of the compiling tray 602 and the arm 202 near the sensor 606 into the stacking tray 604. As sheets travel down the compiling tray 602, the sheets butt up against a side guard 608.

The sensor 606 may detect edges of the sheets as they pass by, such as detecting the trailing edge of sheets being compiled. For example, the sensor 606 may detect a level of the trailing edge of sheets so that an action, such as stapling or hole-punching may occur on the trail edge while the sheets are still in the compiling tray 602, before moving into the stacking tray 604. As the compiled sheets are ejected, move or fall vertically from the compiling tray 602 into the stacking tray 604, the sensor 606 may detect an edge of the sheets and adjust the height of the stacking tray 604. For high performance xerographic machines, the stacking tray 604 may have the capacity to hold thousands of sheets. Various embodiments may include zero, one or more sensors 606 mounted in various positions and in configurations including various media processing operations. In this exemplary embodiment, the sensor 606 is a through beam sensor, but other embodiments may include any type of sensor 606 suitable for the media processing operations. In one embodiment, the sensor 606, detects the position or orientation of the arm 202 and this information is used to coordinate movement of the stacking tray 604. For example, detection of the arm 202 in its locked horizontal position along with the height of the stack in the stacking tray 604 may be used to determine a maximum height of the stacking tray 604.

When a set of sheets is ejected from the compiling tray 602 of the finishing device 600, the stacking tray 604 lowers and the weight of the set causes the arm 202 to pivot out of the way. The arm 202 may be designed in such a manner that there is a counterbalance (e.g., the arm counterbalance 304 shown in FIG. 3) tending to return the arm 202 to a horizontal fixed position. At this point, the stacking tray 604 elevates and causes the stack to be compressed by the contact member 106 of the arm 202. As the stacking tray 604 continues to rise, the arm 202 is locked in a horizontal position.

Figure 7:
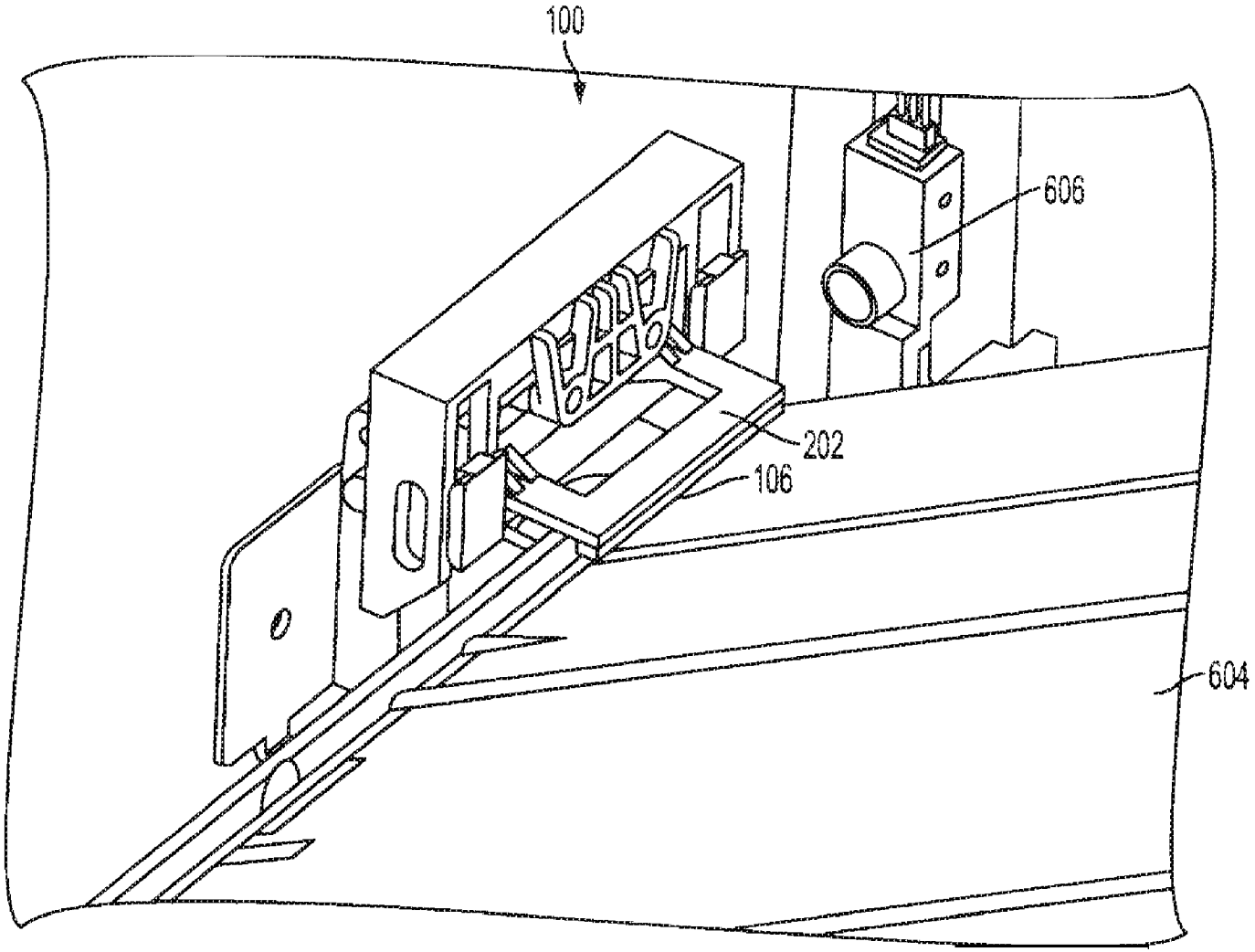
FIG. 7 illustrates another cut away view of the installed modular unit of FIG. 3.

FIG. 7 illustrates another cut away view of the installed modular unit of FIG. 3. In FIG. 7, the compiling tray 400, side guard 406 and other parts of FIG. 6 are removed to more clearly show the installed modular unit 100 of FIG. 3. In one exemplary embodiment, the modular unit 100 may also improve small, stapled set stacking capacity as one or more arms 202 at various locations compress the stack in the stacking tray 402 near a staple location, providing a more stable output in the stacking tray 402 on which the next set may stack.

Figure 8:
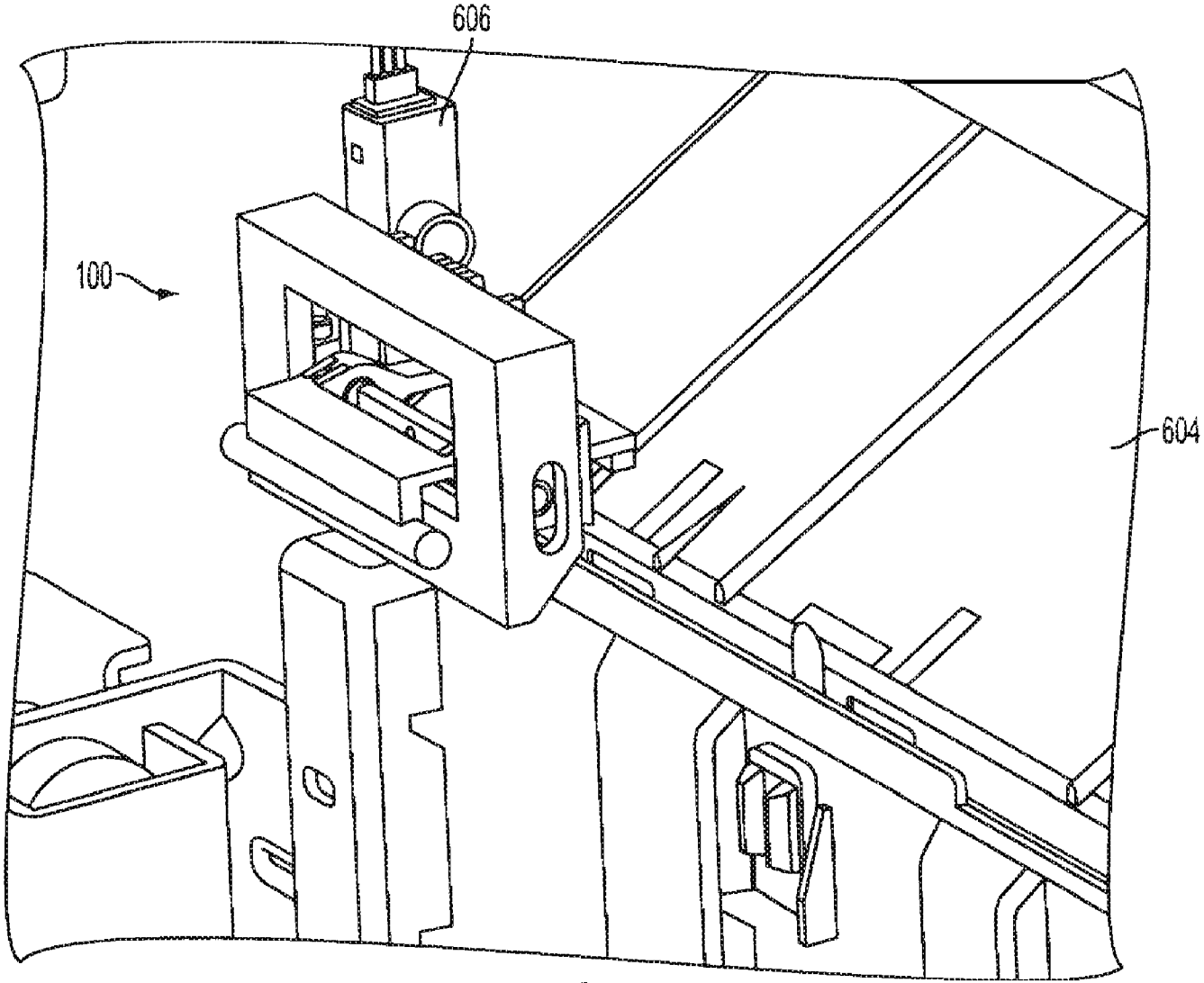
FIG. 8 illustrates another cut away view of the installed modular unit of FIG. 3.

FIG. 8 illustrates another cut away view of the installed modular unit 100 of FIG. 3. One exemplary embodiment of the modular unit 100 is a mechanical device used in conjunction with the sensor 606, which provides the stack height position in the stacking tray 604 via a feedback loop. The mechanical device may be relatively small so that it may be mounted in a back wall of the stacking tray 604 near the top limit, as shown in FIG. 8. The mechanical device includes the gravity-activated arm 202, which moves out of the way when a set is ejected and, then, as the stacking tray 604 lowers, the arm 202 returns to the extended position. As the stacking tray 604 rises again to the compiling position for the next set, the arm 202 is pushed upwards under a spring load, which compresses the set with the rubber contact member 106. This compression reduces the stack height, increases the capacity of the stacking tray 604 and prevents the unfinished set (e.g., unstapled set or set without holes punched) from being pushed out during the compiling and ejection of the subsequent set.

Although exemplary embodiments of the modular unit 100 have been mainly described as a gravity-activated mechanical device, an electro-mechanical device may also be used to implement the concepts described herein. Exemplary embodiments may include integrated parts instead of a modular unit or the geometry may be integrated as part of other parts in the media handling device. Exemplary embodiments may include additional sensors in various positions to reliably detect the edges of the sheets moving into the stacking tray. Exemplary embodiments may include multiple modular units in various configurations, perhaps working cooperatively to stabilize and compress a stack of sheets of various sizes and thicknesses and for various media handling units. Although exemplary embodiments have been mainly described for a finishing device, the concepts described herein may also be applied to other media handling activities, such as feeding and transport. It one embodiment, the modular unit 100 includes a dampening device. The dampening device basically includes a spring and hydraulics to permit variability in the height of the arm of the pressing plate.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A device for stabilizing a movable stack of media in a xerographic machine that ejects a set of media in the stack, comprising:

an arm configured to rotate to a first position in a direction away from the moveable stack of media when the set in the moveable stack of media is ejected, and configured to rotate to a second position when the moveable stack of media lowers;

a contact member coupled to the arm for compressing the moveable stack of media by contacting a top portion of the moveable stack of media as the moveable stack of media rises to a compiling position for a next set; and a counterbalance to the arm with the contact member for stabilizing the motion of the arm.

2. The device of claim 1, wherein the arm is gravity-activated.

3. The device of claim 1, further comprising:

a spring-loaded frame providing support for the moveable stack of media, wherein the contact member compresses the moveable stack of media under a spring-load.

4. The device of claim 1, further comprising:

a spring-loaded frame for mounting the arm thereto to permit the arm to move up with the moveable stack of media.

5. The device of claim 4, the spring-loaded frame further comprising:

a pressing plate that couples the arm to the contact member, the pressing plate having a pair of pivots;

a housing having at least one bearing pivot coupled to a compression spring; and a shaft passing through the pivots of the pressing plate and the bearing pivot of the housing.

6. The device of claim 5, wherein the bearing pivot is shaped with a flat side to limit rotation of the pressing plate around the shaft.

7. The device of claim 5, further comprising:

a pin disposed in the shaft to prevent over-rotation of the pressing plate around the shaft.

8. The device of claim 1, further comprising:

a locking mechanism configured to lock the arm in a horizontal position as the contact member compresses the moveable stack of media.

9. A finishing unit including at least one device of claim 1.

10. A method for stabilizing a movable stack of media, comprising:

moving an arm configured to rotate to a first position away from the movable stack of media, when a set in the movable stack of media is ejected;

returning the arm to a second position, when the movable stack of media lowers;

compressing the top portion of the movable stack of media against a contact member coupled to the arm, as the movable stack of media rises to a compiling position for a next set; and moving the arm to the first position in a direction away from the movable stack of media under the weight of the set being ejected.

11. The method of claim 10, further comprising:

activating the arm by gravity.

12. The method of claim 10, further comprising:

locking the arm in a horizontal position as the contact member compresses the movable stack of media.

13. The method of claim 11, further comprising:

pushing the arm upwards under a spring load, as the movable stack of media rises.

14. The method of claim 10, further comprising:

returning the arm to the second position due to an arm counterbalance.

15. The method of claim 10, wherein the arm is pushed upwards under a spring load, as the movable stack of media rises.

16. A device for stabilizing a stack of media, comprising:

an arm;

a contact member coupled to the arm;

means for rotating the arm to a first position away from the stack of media, when a set in the stack of media is ejected;

means for returning the arm to a second position, when the stack of media lowers; and means for compressing a top portion of the stack of media against the contact member coupled to the arm, as the stack of media rises to a compiling position for a next set, wherein the arm is gravity-activated.

17. The device of claim 16, further comprising:

a locking mechanism configured to lock the arm in a horizontal position as the contact member compresses the stack of media.

* * * * *